United States Patent [19]

Ishida

[11] 4,200,083

[45] Apr. 29, 1980

[54] SPLIT OPERATION TYPE MULTI-CYLINDER INTERNAL COMBUSTION ENGINE

[75] Inventor: Yasuhiko Ishida, Mishima, Japan

[73] Assignee: Toyota Jidosha Kogyo Kabushiki Kaisha, Toyota, Japan

[21] Appl. No.: 949,540

[22] Filed: Oct. 10, 1978

[30] Foreign Application Priority Data

Jul. 6, 1978 [JP] Japan ..... 53/81422

[51] Int. Cl.[2] ..... F02D 17/00

[52] U.S. Cl. ..... 123/198 F; 123/124 R; 261/23 A; 261/47

[58] Field of Search ..... 123/198 F, 124 R, 59 PC; 261/23 A, 47

[56] References Cited

U.S. PATENT DOCUMENTS

| | | | |
|---|---|---|---|
| 2,085,818 | 7/1937 | Messinger | 123/198 F |
| 2,114,655 | 4/1938 | Leibing | 123/198 F |
| 3,698,371 | 10/1972 | Mitsuyama | 123/198 F |
| 4,019,479 | 4/1977 | Garabedian | 123/198 F |
| 4,070,994 | 1/1978 | Garabedian | 261/23 A |
| 4,073,278 | 2/1978 | Glenn | 261/23 A |
| 4,106,471 | 8/1978 | Nakajima | 123/198 F |
| 4,109,634 | 8/1978 | Garabedian | 123/198 F |
| 4,130,102 | 12/1978 | Churchill | 123/198 F |

*Primary Examiner*—Ira S. Lazarus

*Attorney, Agent, or Firm*—Kenyon & Kenyon

[57] ABSTRACT

Disclosed is a split operation type internal combustion engine having a plurality of cylinders which are divided into a first cylinder group and a second cylinder group. The cylinders of the first cylinder group are connected to a first common intake manifold equipped with a first carburetor, and the cylinders of the second cylinder group are connected to a second common intake manifold equipped with a second carburetor. The second intake manifold is connected to the atmosphere via a bypass passage, and an air valve is arranged in the bypass passage. A first gear actuated by the accelerator pedal is operatively connected to the first throttle valve of the first carburetor and intermittently engaged with a second gear connected to the second throttle valve of the second carburetor. The firing operation is always carried out in the first cylinder group. When the level of the vacuum produced in the first intake manifold is greater than a predetermined level, the second throttle valve remains closed, and the air valve remains fully opened. At this time, air is fed into the second cylinder group. When the level of the vacuum produced in the first intake manifold is reduced below the predetermined level, the first gear comes into engagement with the second gear for opening the second throttle valve and, at the same time, the air valve is closed so that the firing operation is started in the second cylinder group.

13 Claims, 6 Drawing Figures

SPLIT OPERATION TYPE MULTI-CYLINDER INTERNAL COMBUSTION ENGINE

DESCRIPTION OF THE INVENTION

The present invention relates to a split operation type multi-cylinder internal combustion engine.

A multi-cylinder engine equipped with a single carburetor normally has such a construction that the amount of air introduced into all of the cylinders of an engine is controlled by a single throttle valve of the carburetor. On the other hand, in the case wherein an engine is provided with a plurality of carburetors, the opening operation of a plurality of throttle valves each being mounted on the respective carburetor is simultaneously carried out in synchronization with each other. In such an engine equipped with a carburetor, when the opening degree of the throttle valve is small and the engine is thus operating under a light load, since a great loss of work (pumping loss) is caused at the time of the intake stroke, a specific fuel consumption is increased. On the other hand, this specific fuel consumption is gradually reduced as the opening degree of the throttle valve is increased. However, particularly in an engine for use in a road vehicle, since much of the operation of the engine is carried out under a partial load wherein the opening degree of the throttle valve is relatively small, a problem occurs in that the specific fuel consumption is increased.

A split operation type engine, in which the cylinders are divided into two cylinder groups, has been proposed for eliminating the above-mentioned problem. In this split operation type engine, when the engine is operating under a light load, air containing no fuel therein is introduced into the cylinders of the second group without being throttled for minimizing the pumping loss; in addition, the cylinders of the first group are operated under a heavy load so that they can compensate the output power which would be generated from the cylinders of the second group if the firing operation of the cylinders of the second group were effected. As a result of this condition, the specific fuel consumption is improved for this split operation type engine. As a typical engine of this type, an engine has been proposed in which each of the intake throttle valves and the fuel supply devices is provided for the respective cylinder groups. In this engine, the throttle valves are mechanically interconnected to each other so that, when the opening degree of the throttle valve of the first cylinder group is increased beyond a predetermined opening degree, the opening operation of the throttle valve of the second cylinder group is started. In addition, a bypass passage is provided for directly communicating the intake passage of the second cylinder group with the atmosphere, and an air valve which is operated in response to vacuum changes in the intake passage of the first cylinder group is arranged in the bypass passage. When the engine is operating under a light load, the throttle valve of the second cylinder group is closed; in addition, the air valve is fully opened so that air is directly introduced into the cylinders of the second cylinder group from the atmosphere via the bypass passage. On the other hand, when the engine is operating under a heavy load, the throttle valve of the second cylinder group is opened; in addition, the air valve is closed for feeding an air-fuel mixture into the cylinders of the second cylinder group. In this engine, as is mentioned above, the throttle valve of the first cylinder group is mechanically connected to the throttle valve of the second cylinder group so that, when the opening degree of the throttle valve of the first cylinder group is increased beyond a predetermined opening degree, the opening operation of the throttle valve of the second cylinder group is started. In addition, the air valve arranged in the bypass passage is actuated by a vacuum-operated air valve actuator so that the position of the air valve is changed to a completely closed position from the fully opened position when the vacuum in the intake passage of the first cylinder group is reduced below a predetermined level. However, if the opening degree of the throttle valve of the first cylinder group is maintained at constant, the level of the vacuum produced in the intake passage of the first cylinder group is increased as the speed of the engine is increased. Consequently, assuming that the opening action of the throttle valve of the second cylinder group is started when the opening degree of the throttle valve of the first cylinder group becomes equal to a predetermined $\alpha$ degree, a problem occurs in that it is impossible to always close the air valve when the opening degree of the throttle valve of the first cylinder group becomes equal to the predetermined $\alpha$ degree. For example, in the case wherein the vacuum-operated air valve actuator is so set that, when the engine is operating at a high speed, the closing operation of the air valve is carried out in response to the level of the vacuum produced in the intake passage of the first cylinder group when the opening degree of the throttle valve of the first cylinder group becomes equal to the predetermined $\alpha$ degree, and when the engine is operating at a low speed, the closing operation of the air valve is then carried out when the throttle valve of the first cylinder group is opened and the opening degree thereof becomes equal to a degree which is smaller than the predetermined $\alpha$ degree. As a result of such condition, since both the air valve and the throttle valve of the second cylinder group are temporarily closed, a great throttling loss is caused in the second cylinder group and, accordingly, loss of output power of the engine is increased. Thus, a problem occurs in that, since the output torque is not smoothly increased when the load of an engine is shifted from a light load to a heavy load, a smooth operation of the engine cannot be obtained.

An object of the present invention is to provide a split operation type engine capable of always obtaining a smooth increase in the output torque by causing the air valve to close in synchronization with the opening operation of the throttle valve of the second cylinder group.

According to the present invention, there is provided an internal combustion engine having a plurality of cylinders which are divided into a first cylinder group and a second cylinder group, the first cylinder group having a first intake passage and a first fuel supply means, the second cylinder group having a second intake passage and a second fuel supply means, the engine comprising: a first throttle valve arranged in the first intake passage for controlling an amount of a combustible mixture fed into the first cylinder group; a second throttle valve arranged in the second intake passage for normally closing the second intake passage to stop inflow of a combustible mixture into the second cylinder group; a bypass passage communicating the atmosphere with the second intake passage located at a position downstream of the second throttle valve; valve means arranged in the bypass passage for normally allowing inflow of air into the second cylinder group; valve actuating means operatively connected to the first throttle valve for increasing the opening degree of the first throttle valve in accordance with an increase in the level of the load of the engine and intermittently connected to the second throttle valve for increasing the opening degree of the second throttle valve in accordance with an increase in the level of the load of the engine when the second throttle valve is connected to the valve actuating means; and, vacuum-operated control means for establishing the mechanical connection between the valve actuating means and the second throttle valve to allow inflow of the combustible mixture into the second cylinder group and for causing the closing operation of said valve means to stop an inflow of air into the second cylinder group when the level of the vacuum produced in the first intake passage is reduced below a predetermined level.

The present invention may be more fully understood from the following description of the preferred embodiments of the invention set forth below, together with the accompanying drawings.

DESCRIPTION OF PREFERRED EMBODIMENTS

Figure 1:
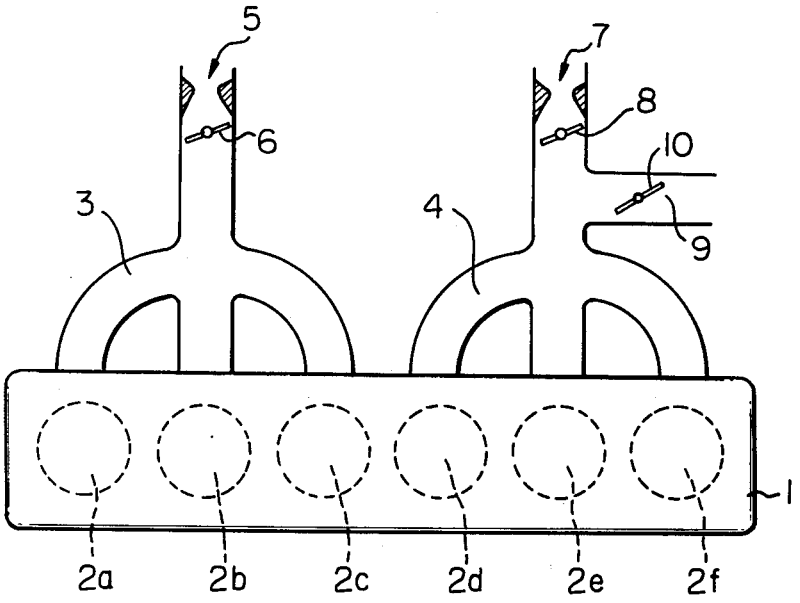
FIG. 1 is a schematic view of an embodiment of an engine according to the present invention.
Figure 2:
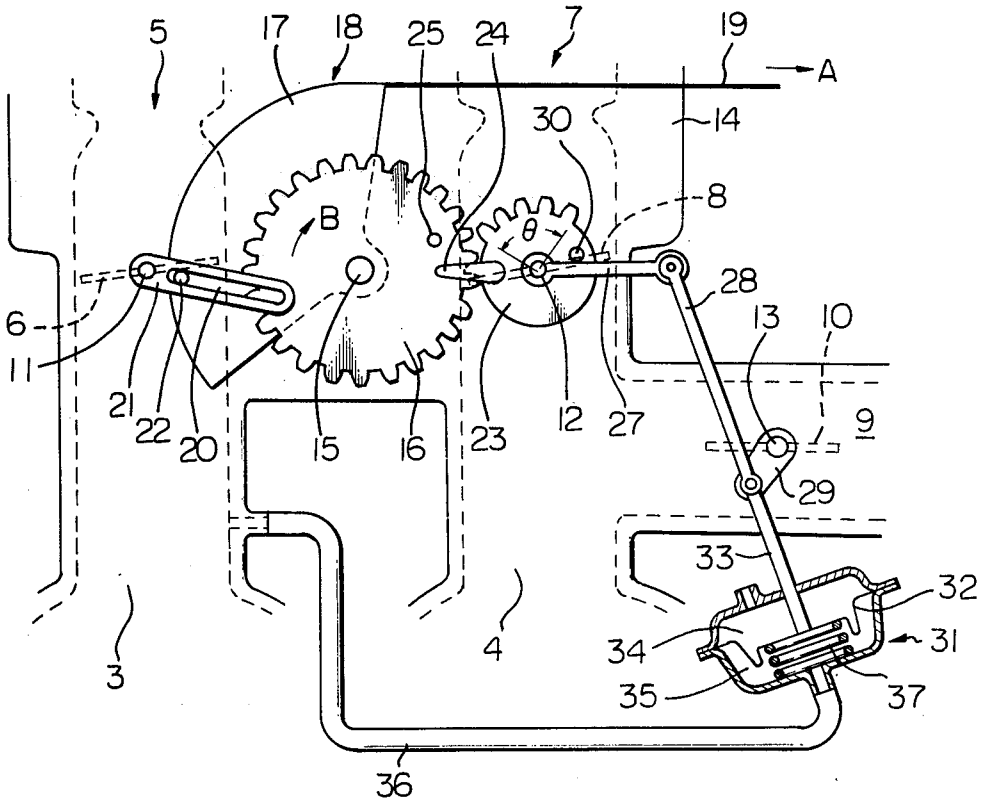
FIG. 2 is a side view of the intake device of an engine.
Figure 3:
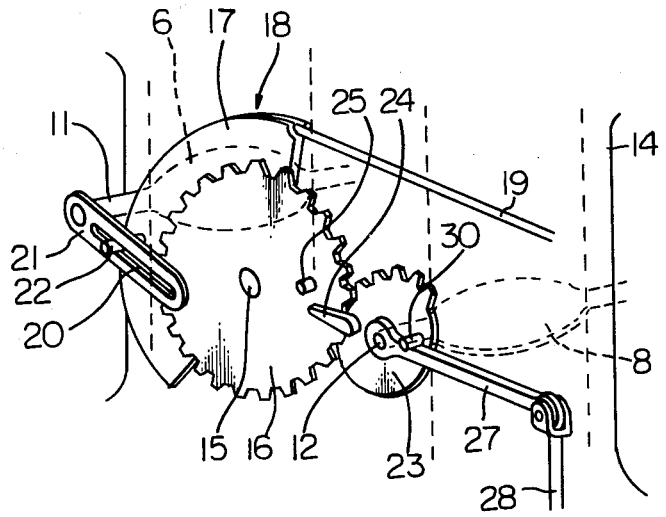
FIG. 3 is a perspective view of the intake device shown in FIG. 2.

FIG. 1 shows a schematic view of an engine according to the present invention. Referring to FIG. 1, reference numeral 1 designates an engine body; *2a, 2b, 2c, 2d, 2e, 2f* designate a cylinder, 3 a first intake manifold common to a first cylinder group of *2a, 2b, 2c;* 4 a second intake manifold common to a second cylinder group of *2d, 2e, 2f;* 5 designates a first carburetor, 6 a first throttle valve of the first carburetor 5; 7 designates a second carburetor, 8 a second throttle valve of the second carburetor 7; 9 designates a bypass passage communicating the atmosphere with the second intake manifold 4 located at a position downstream of the second throttle valve 8; and 10 designates an air valve arranged in the bypass passage 9. FIG. 2 shows an intake device provided with the first throttle valve 6, the second throttle valve 8 and the air valve 10 which are all shown in FIG. 1, and FIG. 3 shows a perspective view of the intake device shown in FIG. 2. Referring to FIGS. 2 and 3, reference numeral 11 designates a throttle shaft of the first throttle valve 6; 12 designates a throttle shaft of the second throttle valve 8; 13 designates a valve shaft of the air valve 10; and 14 designates a carburetor housing including the first carburetor 5 and the second carburetor 7 therein. A pin 15 is fixed onto the carburetor housing 14, and a gear 16 is rotatably mounted on the pin 15. A pulley 17 is fixed onto the rear face of the gear 16, and a wire 19 connected to an accelerator pedal (not shown) is wound on a peripheral groove 18 formed on the pulley 17. Consequently, when the accelerator pedal is depressed and, accordingly, the wire 18 is pulled in the direction shown by the arrow A in FIG. 2, the gear 16 is rotated in the direction shown by the arrow B in FIG. 2 together with the pulley 17. On the other hand, a lever 21 forming a slit 20 thereon is fixed onto the throttle shaft 11 of the first throttle valve 6, and a pin 22 fixed onto the pulley 17 is fitted into the slit 20. Consequently, the first throttle valve 6 is opened as the pulley 17 is rotated in the direction of the arrow B. At this time, as is hereinafter described, the first throttle valve 6 is rapidly opened during the first half of the rotation of the pulley 17, and the first throttle valve 6 remains approximately fully open during the latter half of the rotation of the pulley 17.

As is illustrated in FIG. 2, another gear 23 forming teeth on the outer periphery thereof, only within the range of an angle $\theta$, is fixed onto the throttle shaft 12 of the second throttle valve 8. The throttle shaft 12 is urged in the clockwise direction due to the spring force of the spring (not shown) so that the second throttle valve 8 is normally positioned at a closed position as shown in FIG. 2. In this position, the gear 23 remains disengaged from the gear 16. An arm 24 extending along the front face of the gear 16 is fixed onto the gear 23, and a pin 25 arranged to be engageable with the arm 24 is fixed onto the gear 16. When the gear 23 is rotated by an angle $\theta$ from the position shown in FIG. 2, the second throttle valve 8 is fully opened.

One end of a lever 27 is pivotably mounted on the throttle shaft 12 of the second throttle valve 8, and the other end of the lever 27 is connected via a link 28 to the tip of the arm 29 which is fixed onto the valve shaft 13 of the air valve 10. On the other hand, a pin 30 arranged to be engageable with the lever 27 is fixed onto the gear 23. In addition, the tip of a control rod 33 fixed onto a diaphragm 32 of a vacuum-operated diaphragm apparatus 31 is pivotably connected to the tip of the arm 29. The diaphragm apparatus 31 comprises an atmospheric pressure chamber 34 and a vacuum chamber 35 which are separated by the diaphragm 32. The vacuum chamber 35 is connected via a vacuum conduit 36 to the first intake manifold 3 located at a position downstream of the first throttle valve 6. In addition, a compression spring 37 is inserted into the vacuum chamber 35 for always biasing the diaphragm 32 towards the atmospheric pressure chamber 34.

FIG. 2 shows the case wherein an engine is operating under an idling condition. When the accelerator pedal (not shown) is depressed and, accordingly, the pulley 17 is rotated in the direction of the arrow B, the first throttle valve 6 is opened. At this time, as is illustrated in FIG. 2, the second throttle valve 8 remains completely closed, and the air valve 10 remains fully opened. Consequently, the firing operation is carried out in the first cylinder group of *2a, 2b, 2c* and, on the other hand, air is introduced into the second cylinder group *2d, 2e, 2f* via the bypass passage 9 and the second intake manifold 4. Consequently, at this time, the firing operation is not carried out in the second cylinder group of *2d, 2e, 2f.* The level of the vacuum produced in the first intake manifold 3 located at a position downstream of the first throttle valve 6 is gradually reduced as the opening degree of the first throttle valve 6 is increased. When vacuum in the first intake manifold 3 becomes equal to a predetermined set level, the diaphragm 32 of the diaphragm apparatus 31 moves upwards due to the spring force of the compression spring 37. As a result of this, the air valve 10 is rotated in the clockwise direction to be completely closed and, at the same time, since the lever 27 pushes the pin 30 upwards, the gear 23 is rotated in the counterclockwise direction, whereby the teeth of the gear 23 come into engagement with the teeth of the gear 16. After this, when the accelerator pedal is further depressed and, accordingly, the gear 16 is rotated in the direction of the arrow B, the gear 23 is rotated in the counterclockwise direction by the gear 16 and, as a result, the second throttle valve 8 is gradually opened. Consequently, the firing operation of the engine is started in the second cylinder group of *2d, 2e, 2f*. When the second throttle valve 8 is rotated by an angle $\theta$ from its closed position to become fully opened, the gear 23 is disengaged from the gear 16. Consequently, after this, even if the gear 16 is further rotated, the gear 23 remains stopped and the second throttle valve 8 remains fully opened.

Figure 4:
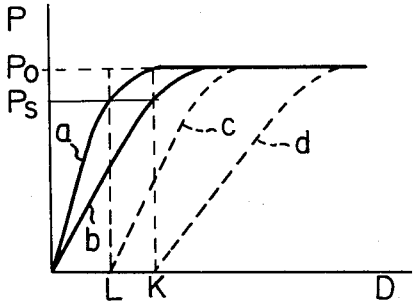
FIG. 4 is a graph showing the relationship between the depression of the accelerator pedal and the vacuum produced in the intake manifold.
Figure 5:
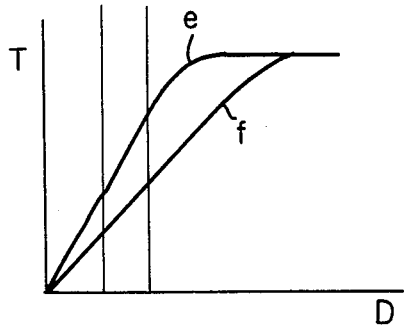
FIG. 5 is a graph showing the relationship between the depression of the accelerator pedal and the output torque of an engine; and, FIG. 6 is a side view of an alternative embodiment of the intake device of an engine according to the present invention.

FIG. 4 shows the relationship between the depression of the accelerator pedal and the level of the vacuum in the intake manifold, and FIG. 5 shows the relationship between the depression of the accelerator pedal and the output torque of the engine. In FIG. 4, the abscissa indicates the depression D of the accelerator pedal, and the ordinate indicates the level of the absolute pressure P in the intake manifold. In addition, in FIG. 4, Po of the ordinate indicates the atmospheric pressure, and Ps of the ordinate indicates a predetermined set vacuum level at which the diaphragm begins to move upwards due to the spring force of the compression spring. On the other hand, in FIG. 5, the abscissa indicates the depression D of the accelerator pedal, and the ordinate indicates the output torque T of an engine. In FIG. 4, the curved line a indicates the vacuum level produced in the first intake manifold when the engine is operating at a low speed; the curved line b indicates the vacuum level produced in the first intake manifold when the engine is operating at a high speed; the curved line C indicates the vacuum level produced in the second intake manifold when the engine is operating at a low speed; and the curved line d indicates the vacuum level produced in the second intake manifold when the engine is operating at a high speed. On the other hand, in FIG. 5, the curved line e indicates the output torque of the engine when the engine is operating at a low speed, and the curved line f indicates the output torque of the engine when the engine is operating at a high speed.

In FIG. 4, the pressure in the first intake manifold becomes approximately equal to the atmospheric pressure Po when the first throttle valve is fully opend. Consequently, from FIG. 4, it will be understood that the first throttle valve is rapidly opened during the first half of the depression of the accelerator pedal, and the first throttle valve remains approximately fully open during the latter half of the depression of the acceleration pedal. In addition, from FIG. 4, it will be understood that the depression D of the accelerator pedal, that is, the opening degree of the first throttle valve, in which the vacuum corresponding to the predetermined set level Ps is produced in the first intake manifold, is increased as the speed of the engine is increased.

As is mentioned previously, a conventional engine is so constructed that the opening operation of the second throttle valve 8 is started when the depression D of the accelerator pedal becomes equal to, for example, the depression shown by K in FIG. 4. Consequently, when the engine is operating at a high speed as shown by the curved line b, no problem occurs because the opening operation of the second throttle valve 8 is started at the same time when the air valve 10 is closed. However, when the engine is operating at a low speed as shown by the curved line a in FIG. 4, the air valve 10 is closed when the depression D of the accelerator pedal is increased beyond the depression shown by L in FIG. 4. Consequently, since both the second throttle valve 8 and the air valve 10 remain closed when the depression D of the accelerator pedal is within the range of between L and K shown in FIG. 4, the intake throttling loss is considerably increased in the second intake manifold 4 and, as a result, the output torque of the engine is reduced. However, in the present invention, since the opening operation of the second throttle valve 8 is always carried out in synchronization with the closing operation of the air valve 10, independent of the speed of the engine, a smooth increase in the output torque of the engine can be ensured, independent of the speed of the engine, as shown in FIG. 5.

In the embodiment shown in FIGS. 2 and 3, there is a danger that, when the accelerator pedal is rapidly depressed, the gear 23 cannot come into appropriate engagement with the gear 16 due to presence of a time lag in the operation of the diaphragm apparatus 31. In order to avoid occurrence of this danger, the arm 24 and the pin 25 are provided in the present invention. That is, when the accelerator pedal is rapidly depressed, the pin 25 causes the lever 24 to move downward, whereby the gear 23 can come into engagement with the gear 16. However, the gear 23 normally comes into engagement with the gear 16 by means of the diaphragm apparatus 31 before the pin 25 abuts against the arm 24.

Figure 6:
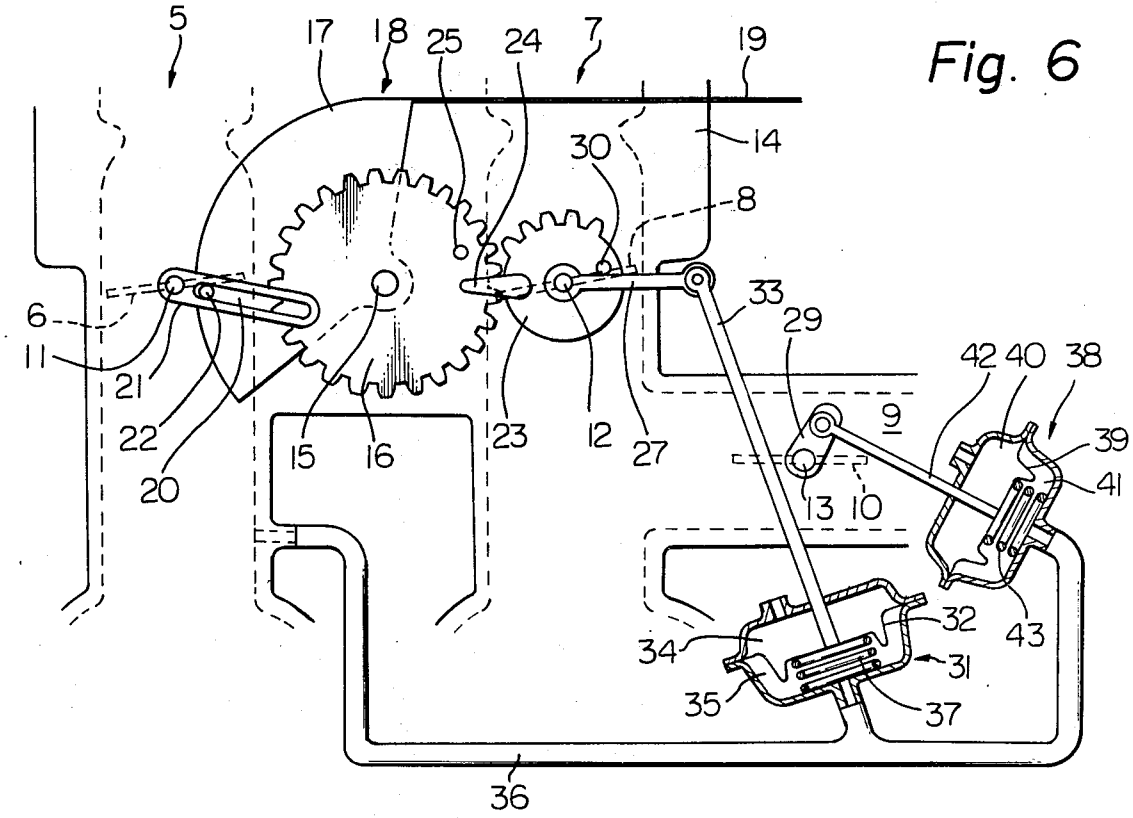

FIG. 6 shows an alternative embodiment according to the present invention. Referring to FIG. 6, another vacuum-operated diaphragm apparatus 38 is provided in addition to the diaphragm apparatus 31, and the control rod 33 of the diaphragm apparatus 31 is solely connected to the lever 27. The diaphragm apparatus 38 comprises an atmospheric pressure chamber 40 and a vacuum chamber 41 which are separated by a diaphragm 39, and the tip of a control rod 42 fixed onto the diaphragm 39 is pivotably connected to the tip of the arm 29 fixed onto the valve shaft 13 of the air valve 10. A compression spring 43 is inserted into the vacuum chamber 41 for urging the diaphragm 32 towards the atmospheric pressure chamber 40, and the vacuum chamber 41 is connected to the vacuum conduit 36. In this embodiment, the compression spring 37 of the diaphragm apparatus 31 is slightly stronger than the compression spring 43 of the diaphragm apparatus 38. Consequently, in this embodiment, when the accelerator pedal is depressed, the gear 23 initially comes into engagement with the gear 16 and, as a result, the second throttle valve 23 is opened. Then, after a little while, the air valve 10 is fully opened.

According to the present invention, since the opening operation of the second throttle valve is carried out in synchronization with the closing operation of the air valve, a smooth increase in the output torque of the engine can be obtained when the accelerator pedal is depressed.

Although the invention has been described above with reference to specific embodiments chosen for purposes of illustration, it should be apparent that numerous modifications could be made thereto by those skilled in the art without departing from the spirit and scope of the invention.

What is claimed is:

1. An internal combustion engine having a plurality of cylinders which are divided into a first cylinder group and a second cylinder group, said first cylinder group having a first intake passage and a first fuel supply means, said second cylinder group having a second intake passage and a second fuel supply means, said engine comprising:

a first throttle valve arranged in said first intake passage for controlling an amount of a combustible mixture fed into said first cylinder group;

a second throttle valve arranged in said second intake passage for normally closing said second intake passage to stop inflow of a combustible mixture into said second cylinder group;

a bypass passage communicating the atmosphere with said second intake passage located at a position downstream of said second throttle valve;

valve means arranged in said bypass passage for normally allowing inflow of air into said second cylinder group;

a valve actuating means operatively connected to said first throttle valve for increasing the opening degree of said first throttle valve in accordance with an increase in the level of a load of said engine and intermittently connected to said second throttle valve for increasing the opening degree of said second throttle valve in accordance with an increase in the level of the load of said engine when said second throttle valve is connected to said valve actuating means; and, vacuum-operated control means for establishing mechanical connection between said valve actuating means and said second throttle valve to allow inflow of the combustible mixture into said second cylinder group and for causing the closing operation of said valve means to stop inflow of air into said second cylinder group when the level of the vacuum produced in said first intake passage is reduced below a predetermined level.

2. An internal combustion engine as claimed in claim 1, wherein said valve actuating means comprises a first rotary member operatively connected to said first throttle valve and rotated in accordance with an increase in the level of the load of said engine, and a second rotary member connected to said second throttle valve and arranged to be engageable with said first rotary member, said second rotary member remaining disengaged from said first rotary member when the level of the vacuum produced in said first intake passage is greater than said predetermined level, while said vacuum-operated control means causes said second rotary member to come into engagement with said first rotary member when the level of the vacuum produced in said first intake passage is reduced below said predetermined level.

3. An internal combustion engine as claimed in claim 2, wherein said first rotary member comprises a first gear, and said second rotary member comprises a second gear.

4. An internal combustion engine as claimed in claim 3, wherein said second gear has teeth which are partially formed along an outer periphery of said second gear.

5. An internal combustion engine as claimed in claim 2, wherein said vacuum-operated control means comprises a diaphragm apparatus having a vacuum chamber which is defined by a diaphragm, said vacuum chamber being connected to said first intake passage, said diaphragm being connected to said valve means and operatively connected to said second rotary member.

6. An internal combustion engine as claimed in claim 5, wherein said diaphragm has a rod extending therefrom, said rod being connected to a lever which is arranged to be rotatable about an axis of said second rotary member, said second rotary member having thereon a pin which is arranged to be engageable with said lever, the engagement of said lever and said pin causing said first rotary member and said second rotary member to come into engagement with each other.

7. An internal combustion engine as claimed in claim 2, wherein said vacuum-operated control means comprises a first diaphragm apparatus and a second diaphragm apparatus each having a vacuum chamber which is defined by a diaphragm, said vacuum chambers of said first and second diaphragm apparatuses being connected to said first intake passage, said diaphragm of said first diaphragm apparatus being connected to said valve means, said diaphragm of said second diaphragm apparatus being operatively connected to said second rotary member.

8. An internal combustion engine as claimed in claim 7, wherein each of said first and second diaphragm apparatuses comprises a compression spring arranged in said vacuum chamber for biasing said diaphragm, said compression spring of the second diaphragm apparatus being stronger than the compression spring of said first diaphragm apparatus.

9. An internal combustion engine as claimed in claim 1, wherein said valve actuating means comprises a rotary member rotated in accordance with an increase in the level of the load of said engine, and link means interconnecting said rotary member with said first throttle valve for rapidly opening said first throttle valve during the first half of the rotation of said rotary member and for causing said first throttle valve to remain fully open during the latter half of the rotation of said rotary member.

10. An internal combustion engine as claimed in claim 9, wherein said link means comprises a lever connected to said first throttle valve and having a slit, and a pin mounted on said rotary member and fitted into said slit of the lever connected to said first throttle valve.

11. An internal combustion engine as claimed in claim 1, wherein said valve actuating means comprises connecting means for establishing a mechanical connection between said valve actuating means and said second throttle valve, independent of the level of the vacuum produced in said first throttle valve, when the level of the load of the engine is rapidly increased.

12. An internal combustion engine as claimed in claim 11, wherein said valve actuating means further comprises a first gear operatively connected to said first throttle valve and rotated in accordance with an increase in the level of the load of the engine, and a second gear connected to said second throttle valve and arranged to be engageable with said first gear, said connecting means causing said first gear and said second gear to engage with each other when said first gear is rapidly rotated.

13. An internal combustion engine as claimed in claim 12, wherein said connecting means comprises a pin mounted on said first gear, and an arm mounted on said second gear and arranged to be engageable with said pin of the first gear.

* * * * *